US006312190B1

(12) United States Patent
Goughnour

(10) Patent No.: US 6,312,190 B1
(45) Date of Patent: Nov. 6, 2001

(54) METHOD AND APPARATUS FOR ENHANCEMENT OF PREFABRICATED COMPOSITE VERTICAL DRAINS

(76) Inventor: R. Robert Goughnour, 705 Duff Rd., NE., Leesburg, VA (US) 20176

( * ) Notice: Subject to any disclaimer, the term of this patent is extended or adjusted under 35 U.S.C. 154(b) by 0 days.

(21) Appl. No.: 09/295,183

(22) Filed: Apr. 20, 1999

(51) Int. Cl.[7] ..... E02B 11/00

(52) U.S. Cl. ..... 405/36; 405/45; 405/49; 210/170; 210/747

(58) Field of Search ..... 405/258, 36, 45, 405/50, 128, 131, 43, 271, 49; 52/169.5, 169.14; 210/747, 170

(56) References Cited

U.S. PATENT DOCUMENTS

| | | | | |
|---|---|---|---|---|
| 1,323,027 | * | 11/1919 | Davis | 405/50 |
| 1,598,300 | | 8/1926 | Moran . | |
| 2,127,175 | * | 8/1938 | Imbertson et al. | 405/50 X |
| 2,482,673 | * | 9/1949 | Kjellman | 405/36 |
| 3,654,765 | * | 4/1972 | Healy et al. | 405/45 |
| 3,965,686 | * | 6/1976 | Saito et al. | 405/43 |
| 4,288,174 | * | 9/1981 | Laws | 405/50 X |
| 4,459,177 | * | 7/1984 | O'Hare | 405/36 X |
| 4,582,611 | * | 4/1986 | Wang | 210/747 |
| 4,622,138 | * | 11/1986 | Wager | 405/50 X |
| 4,923,331 | * | 5/1990 | Kreikemeier | 405/36 X |
| 5,018,576 | * | 5/1991 | Udell et al. | 405/131 X |
| 5,032,042 | * | 7/1991 | Schuring et al. | 405/258 |
| 5,037,240 | | 8/1991 | Sherman | 405/128 |
| 5,076,727 | * | 12/1991 | Johnson et al. | 405/258 X |
| 5,129,757 | * | 7/1992 | Johnson | 405/36 X |
| 5,213,449 | | 5/1993 | Morris | 405/249 |
| 5,345,034 | * | 9/1994 | Corey | 405/258 X |
| 5,456,550 | * | 10/1995 | Devlin | 405/128 |
| 5,617,670 | * | 4/1997 | Benson | 405/258 X |
| 5,660,500 | * | 8/1997 | Marsden et al. | 405/131 X |
| 5,800,090 | | 9/1998 | Goughnour | 405/36 |
| 5,820,296 | | 10/1998 | Goughnour | 405/43 |
| 5,986,159 | * | 11/1999 | Aines et al. | 405/131 |

* cited by examiner

*Primary Examiner*—David Bagnell
*Assistant Examiner*—Sunil Singh
(74) *Attorney, Agent, or Firm*—Carothers & Carothers

(57) ABSTRACT

A vertical prefabricated composite drain for improving conventional consolidated acceleration of saturated soils. The composite drain is installed in a generally vertical manner in water saturated soil to be treated for expelling pore water from the soil and is provided with an elongated core with at least one channel therealong for conveying fluids and is also provided with filter fabric which surrounds the core. At least one elongated tube is installed in juxtaposition and coextension with the drain core and fluid under pressure is forced through the tube for thereby assisting an expulsion of pore water from the drain.

15 Claims, 5 Drawing Sheets

METHOD AND APPARATUS FOR ENHANCEMENT OF PREFABRICATED COMPOSITE VERTICAL DRAINS

BACKGROUND OF THE INVENTION

This invention relates generally to soil improvement, and more particularly to improvements in the operation of vertical prefabricated drains used for consolidation acceleration, and of vertical prefabricated drains used for liquefaction mitigation and remediation.

When loads are placed on the surface of soft, saturated clay deposits, large settlements often result because of compression of the clay material. In saturated material, this settlement can take place only as pore water is expelled. If the permeability of the compressible soil is very low, this process takes place very slowly. Total settlements of several meters are common and often take years to occur. This time-dependent process is called consolidation. A process called sand drains and surcharging has been used in these cases since the 1920's (See D. E. Moran, U.S. Pat. No. 1,598,300).

In this process sand drains (columns of sand) are installed vertically on a regular area pattern through the soft layer to be treated. After the sand drains are installed, a sand or gravel drainage blanket one to three feet thick is placed over the drains to permit water to flow out of the drains. An earth embankment is placed over this drainage blanket. The thickness of the embankment or surcharge is normally calculated to produce loading roughly 10% greater than the anticipated final design load planned for the project.

The sand drains now provide free drainage paths within the clay mass. Without drains, drainage from any point within the clay must take place vertically, either to the surface, or downward to a permeable soil layer below, if such layer is present. With drains present, the drainage distance from any point within the clay is to the nearest drain. Drains are spaced so that drainage paths are much shortened, and consolidation occurs much more rapidly. The surcharge is left in place until the consolidation process is nearly complete (commonly about 90%). This creates a condition where the soil skeleton (or soil grains) is loaded to a level equal to or somewhat greater than the anticipated design load. The surcharge is then removed and the project proceeds. Since the soft soil skeleton has been precompressed to a load somewhat greater than the design load, no more settlement occurs.

In the late 1960's and early 1970's, wick drains were developed as an alternative to sand drains. Wick drains are not truly wicks, but are composite drains composed of an extruded flexible plastic core 12 (see FIG. 1), shaped to provide drainage channels 13 when the core is wrapped in a special filter fabric 14. See also U.S. Pat. No. 5,820,296. The filter fabric 14 (geofabric or geotextile) acts as a filter, constructed with opening sizes which prevent the entrance of soil particles, but allow pore water to enter freely. The finished wick material or drain is strip or band-shaped, typically about ⅛ to ¼ inch thick, and approximately 4 inches wide. It is provided in rolls containing 800 to 1000 feet of drain. An example manufacturer is American Wick Drain Corporation of Matthews, North Carolina, U.S.A. Its product is sold under the trademark AMERDRAIN.

Another recent development is the use of larger composite drains as a replacement for the sand or gravel drainage blanket. These drains are similar to wick drains but with much larger cross sectional area. They are placed to accept drainage out of the vertical drains and to provide horizontal drainage from under the surcharge. This "under drain system" is very efficient, and is usually cost-effective when compared with a sand or gravel layer.

In another variation, the surcharge may be replaced by a system that applies atmospheric pressure to the ground surface. To apply this method an impervious membrane is placed over the area to be consolidated. The edges of this membrane are placed into a trench and buried to provide an airtight seal around the perimeter of the membrane. A vacuum is then drawn from under the membrane. A system of horizontal drains, as just mentioned, is placed under the membrane and distributes the effects of the vacuum uniformly throughout the treated area. The maximum pressure that can be realized in practice is about 70% to 80% of atmospheric, and is equivalent to approximately a 15-foot high embankment.

Another application for vertical prefabricated drains in ground improvement is for liquefaction mitigation and remediation. One of the most destructive effects of earthquakes is their effect on deposits of saturated loose, fine sand or silty sand, causing a phenomenon known as liquefaction. When liquefaction occurs the soil mass loses all shear strength and behaves temporarily as a liquid. Such temporary loss of shear strength can have catastrophic effects on earthworks or structures founded on these deposits. Major landslides, lateral movement of bridge supports, settling or tilting of buildings, and failure of waterfront structures have all been observed in recent years, and efforts have been increasingly directed toward development of methods to prevent or reduce such damage.

When loose sand is subjected to repeated shear strain reversals, such as caused by an earthquake, the volume of the sand will decrease. If the sand is saturated and drainage out of the sand is prevented, it will be understood that since the volume of the sand is decreasing, the pressure of the water must increase. As the water pressure becomes greater the grain-to-grain contact pressure in the sand must become smaller and smaller. When this grain-to-grain contact pressure becomes zero, the entire sand mass will lose all shear strength and will act as a liquid. This phenomenon is known as liquefaction and can occur in loose, saturated sand deposits as a result of earthquakes, blasting, or other shocks.

One recently developed method of treating liquefiable soil for earthquake protection, comprises a plurality of substantially vertical prefabricated drains positioned at spaced intervals in the liquefiable soil and a reservoir, which is adapted for draining off water that is expelled from these composite drains (see U.S. Pat. No. 5,800,090). The object is to provide pore water pressure relief from a series of spaced locations within a liquefiable soil by providing an open drainage path, which operates as efficiently as possible—i.e. requires as little pressure as possible to move the required amount of water.

In the previous application where vertical drains were used for consolidation acceleration, drainage through the drains normally takes place over a period of several weeks, months, or even years. In this case, drainage must take place during strong shaking of the earthquake event, which is only a matter of seconds. The drains used in this application must provide flow capacity at least two orders of magnitude greater than normal wick drains.

One product that meets this requirement is the larger composite drains as mentioned above. This product is similar to wick drains but with a thickness of 1 to 1½ inches, and a width of 6 inches or more. Another recently developed product is corrugated plastic pipe. This product is perforated or slotted and can be wrapped in a geofabric. When used for liquefaction mitigation this product will have an inside diameter of from 2 to 10 or 12 inches.

Installation of vertical drains is accomplished by means of specialized equipment, consisting of a crane-mounted, vertical mast housing a special installation mandrel. The mandrel, containing the drain, is intruded by force directly into the ground from the bottom of the mast. After reaching the desired depth, the mandrel is withdrawn back into the mast, leaving the undamaged drain in place within the soil. For example, see U.S. Pat. No. 5,213,449. Sometimes vertical vibration is applied to the mandrel to aid in penetration. Typical spacing for wick drains is from three to ten feet. This well proven method of ground improvement has found extensive application where foundation materials are saturated and compressible, with moisture contents up to 100%. Such foundation materials include clays; soft, fine silts; organic deposits; and peat or "muck". This method is very cost-effective and has virtually replaced the older sand drain method. For liquefaction remediation, drain spacings can vary from 2 to 6 or 7 feet.

Pore Water Pressure Distribution in Soil

In order to understand pore water pressure distribution in soils, it is necessary to consider the effects of capillary forces. It is well know that water will rise to some height, in a capillary tube. The height of this rise is given by $$h_c=(4T_s \cos \alpha)/d\gamma_w \quad (1)$$

where $T_s$ is the surface tension per unit length in the water, $\alpha$ a is the contact angle between the meniscus and the tube surface, d is the diameter of the capillary tube, and $\gamma_w$ is the unit weight of water. The angle $\alpha$ depends on the affinity of the water for the mineral of the tube wall. If d becomes very small, $h_c$ becomes very large, and is not limited by the magnitude of atmospheric pressure as is the case where water is drawn up into a pipe by a vacuum. At the water surface the pressure is atmospheric, or the gage pressure is zero. Below this level in the water reservoir the pressure is positive. Above this level in the capillary tube the pressure is below atmospheric, or the gage pressure is negative, and equal to $$p=-h_c\gamma_w \quad (2)$$

The situation with respect to capillary rise in soils is considerably more complicated than the foregoing because of the variations in pore space size in even relatively uniform soils. In general, the distribution of pore size is not known, and it is not measured by any of the tests normally employed. The average pore diameter is frequently estimated as approximately one-fifth of the average grain diameter in a uniform soil, and as equivalent to the 10 percent size in well-graded soils. However, the diameter of any one pore will vary greatly as one traces its position within the soil. This variability of pore diameters causes the height of capillary rise in soil to depend on the direction of motion of the soil water.

The phreatic level is defined as the height at which the fluid pressure is atmospheric (corresponds to the free water level in a reservoir or well). Below this level the fluid pressure is positive. Above this level the fluid pressure is lower than atmospheric or the gage pressure is negative. For some distance above the phreatic level the soil is essentially saturated, or the pore spaces are completely filed with water. Above this level is a zone where the soil is only partially saturated, but the moisture is continuous. This occurs as the water migrates back into the portions of the pore spaces with smaller diameter. The pressure within the water in the saturated, and the partially saturated but continuous moisture, zones is given by equation (2).

Above the partially saturated, continuous moisture zone the soil is partially saturated but the moisture is not continuous. The pressure within each pocket of moisture is determined by the effective diameter of the portion of the pore space occupied. As the soil dries out by evaporation the pore water migrates into portions of the pore space with smaller and smaller effective diameter. The negative pressure within this zone can become very large, which applies large compressive forces to the soil skeleton. This mechanism is commonly responsible for the formation of a "crust" or hard surface soil layer, which generally overlies soft soil.

Effect of Loading

When loads are added to the surface of a saturated, fine-grained soil, the immediate effect is to alter the pressure in the pore water within the soil. Because the pore water is much less compressible than the soil skeleton the load is essentially carried by increased pore water pressure. If the permeability of the soil is very low, water can move only slowly through the soil, and this excess pressure is dissipated slowly. In order to understand the operation of this mechanism it is necessary to look at the pore water pressure distribution before and after the load is applied.

At some short time after a widespread load has been applied at the soil surface, the immediate effect will be that the load is essentially carried by increased pore water pressure at a location remote from the drain and in the saturated zone. In the saturated zone this pressure increase is constant with depth for a widespread surface load.

In the partially saturated zone the pore spaces contain varying amounts of air. Consequently, the compressibility of the composite material filling the void spaces becomes greater as the portion of air becomes larger. The increment of load carried by the mixture of air and water in the pore spaces becomes smaller as the proportion of air in the void spaces becomes greater.

Because of the pressure increase in the soil carried by the pore water, water will migrate toward the drain. The drain will quickly fill with water and overflow. The pressure distribution within the drain is then controlled by the elevation of the top of the drain, and this pressure distribution will be transferred to the soil in close proximity to the drain. The pressure at or near the drain perimeter is less than that at distance from the drain. Because of this pressure differential, water will migrate toward the drain and dissipate by overflowing out of the top of the drain (this assumes that provisions for lateral drainage from under the load are in place). Eventually the pressure distribution throughout the soil will be the same as that near the drain. As the pore water drains away and the excess pore pressure dissipates, load is transferred to the soil skeleton. As the soil skeleton takes more load it compresses causing settlement of the ground surface.

Pore water dissipation, with the pressure controlled by the elevation of the top of the drain, will occur rather rapidly. Further dissipation of pore water pressures will occur more slowly because additional drainage must take place laterally through the soil to regions outside of the loaded area. Eventually the pressure distribution will return to equilibrium pore water pressures.

Effect of Lowering the Water Level in the Drain

Lowering the water level within the drains reduces the fluid pressure within the drain to zero at or above the new water level. Below the new water level the pressure will be reduced by an amount Δp, given by $$\Delta p = h_l \gamma_w \quad (3)$$

where $h_l$ is the distance the water level was lowered. The pore water pressure in the soil near to the drain will also be reduced by the amount Δp. However the maximum negative pressure that the soil can sustain is still controlled by capillary pressure within the soil.

This reduction in pore water pressure is not immediately realized at a distance from the drain, creating a pressure gradient within the soil. This will induce water migration toward the drains, and this migration will occur, both in the zone below the phreatic surface as well as above it. In the long term desiccation of soil in the zone of partial saturation with discontinuous moisture will migrate downward.

If the water level in the drain is allowed to return to its original equilibrium condition, the pore water pressure distribution will also return to its original condition. The net result will be that the soil skeleton has been precompressed by an amount Δp, up to the limit allowed by capillary forces within the soil. Load up to the magnitude of this precompression can now be applied to the soil without causing additional long-term settlement.

From this analysis the present inventor further recognized that if the water level in the drains were lowered at the same time a surcharge is applied, the combined effects of these two mechanisms would apply. The net result will be that the amount of precompression will be greater than if either were applied singly.

Filter Fabric and Soil Retention

The purpose of the filter fabric surrounding the core of the vertical drain is to prevent soil particles from entering the drain interior while allowing water to enter freely. The ability of the fabric to perform this function depends on the opening size of the fabric pores. The apparent opening size (AOS), or $O_{95}$, is the hole size for which 95% of the openings in the geotextile are smaller.

If the opening size of the geotextile is too large, the soil particles will pass through and the drain interior will become clogged. If the opening size is too small, fine soil particles will block the openings and the geotextile will become clogged. Three simple concepts are used in the choosing the proper AOS for any given soil:

1. If the size of the largest pore in the geotextile filter is smaller than the larger particles of the soil, the filter will retain the soil. As with graded granular filters, the larger particles of soil will form a filter bridge over the hole, which in turn filters smaller particles of soil, in turn, retaining the soil and preventing piping. This process further improves the permeability of the soil in close proximity with the drain, improving the drain's efficiency.
2. If the smaller openings in the geotextile are sufficiently large such that the smaller particles of soil are able to pass through the filter, then the geotextile will not blind or clog.
3. A large number of openings should be present in the geotextile so that proper flow can be maintained even if some of the openings later become plugged.

The smallest practical AOS is on the order of 50μ. Although most soils can be effectively filtered by this or larger AOS sizes, some uniform clays may have maximum particle sizes of 10 to 40μ or smaller. Thus, it is apparent that some soils cannot be effectively filtered. When wick drains are used for acceleration of consolidation in such soil, the fine particles that enter the drain can accumulate over time and clog the drain, leaving it completely nonfunctioning.

SUMMARY OF THE INVENTION

An object of the present invention is to lower the water level within the vertical drains, producing the beneficial results as explained above.

The vertical prefabricated composite drain of the present invention provides improvement in the composite drains of the prior art, by additionally providing an elongated tube in juxtaposition and coextension with the drain and further providing a fluid pump which is connected to the top end of the tube for forcing fluid through the tube. The filter fabric also surrounds the elongated tube. This vertical prefabricated composite drain of the present invention also provides the necessary apparatus for performing the method of the present invention for improving the effectiveness of vertical prefabricated composite drains.

In one embodiment, the fluid pump may be an air pump, and in this embodiment the elongated tube is simply open-ended at its bottom end and exhausts the air under pressure at the bottom of the drain. The air travels back to the ground surface through the vertical drain. In drains of relatively thin cross section and small drain channels, such as is encountered with wick drains, water is carried back to the surface with the air. Additionally, the air bubbling up through the drain assists in keeping fine particle soils in suspension and carried up and out of the drain in order to maintain the drain effective.

Thus, in situations where the soil is so fine that a suitable filter geotextile cannot be found to prevent soil particles from entering the drain, air can be forced upwardly through the elongated tube and agitates the water in the drain keeping soil particles in suspension. Soil particles that may have entered the drain and accumulated at the bottom of the drain are thus flushed out and the drain is cleared. In this situation, only intermittent circulation of the air may be required to flush out particles as they accumulate. In the case of larger drains used for liquefaction mitigation, pumping or flushing with water may be used with the elongated tube to clear accumulated soil and material.

A further beneficial effect of exhausting water from the drains by the apparatus and method of the present invention is that promotion of a natural soil filter at the drain surface will be enhanced. As previously explained, this will improve the drains efficiency. This effect can be realized either by temporary or intermittent pumping, or by long term pumping utilizing the elongated tube.

When air is pumped down the elongated tube, with wick drains having small drain channels of for example 5 mm or less, the air circulation may be continued even after all free water which was in the wick drain is exhausted from the drain. This will promote evaporation of water at the drain surface leading to desiccation of the soil and further compression. Heating the circulated air further enhances this evaporation.

In yet another embodiment of the vertical prefabricated composite drain of the present invention, it is additionally desired to provide evacuation means positioned adjacent an upper end of the composite drain for evacuating water expelled from the drain whereby expelled water will not again penetrate the soil being treated. Examples of such evacuation means includes the use of conventional water pumps connected to the top of the tubes or the composite drains or the use of horizontal drain pipes which are connected to the upper ends of the composite drains.

In yet another embodiment of the composite drain structure of the present invention, two elongated tubes are enclosed within the geofabric or geotextile in juxtaposition and coextension with the drain core. An eductor pump is connected between bottom ends of these two tubes and a water pump is connected to the top end of one of these tubes for pumping water through the tubes and the eductor pump for evacuating pore water from the drain at the bottom thereof to the soil surface for further evacuation.

Particularly in wick drain applications, these elongated drain cores are comprised of elongated flexible plastic core sheets or strips with horizontal corrugations providing a plurality of drain channels. The elongated tube or tubes are also comprised of flexible plastic material for flexing with the drain core so that entire composite drain assembly may be simultaneously stored on a spool prior to insertion into the soil.

Also, earthquake drains of the type described in the inventor's U.S. Pat. No. 5,800,090, in their primary function of liquefaction remediation, do essentially act as wells. As such they should conduct water from the soil into the well as efficiently as possible. This function can be improved by utilizing the apparatus and method of the present invention whereby water is pumped from the drain through the elongated tube to wash the very fine soil particles from the soil near to drain. By washing these fine particles away, a graded filter is formed in the soil near the well. The permeability of the soil is much improved by this process and in normal well terminology this is know as "developing" the well.

Also, pumping tests are used in normal well technology to determine the aquifer characteristics for water supply. This is, of course, well know with respect to conventional water wells. However, it is novel with respect to earthquake drains and liquefaction remediation when used with the structure and method of the present invention. The composite drain of the present invention uniquely permits determination of aquifer characteristics. Thus, for earthquake drains, a pumping test can verify the assumed permeability used for design, and if this is not found to be adequate, additional drains may be installed to meet design criteria.

BRIEF DESCRIPTION OF THE DRAWINGS

Other objects and advantages appear in the following description and claims. The accompanying drawings show, for the purpose of exemplification, without limiting the invention or claims thereto, certain practical embodiments illustrating the principals of this invention, wherein:

DETAILED DESCRIPTION OF THE PREFERRED EMBODIMENTS

Figure 2:
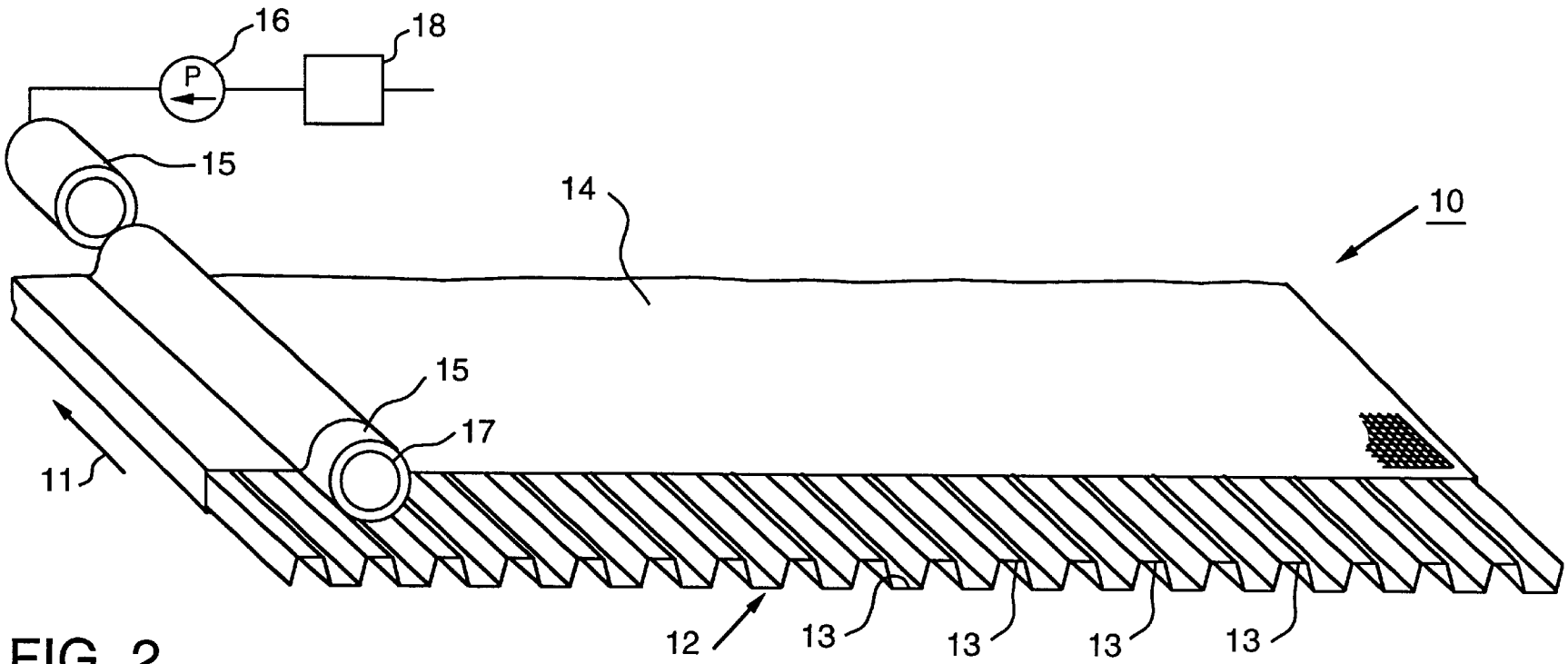
FIG. 2 is a schematic perspective view of one embodiment of the vertical prefabricated composite drain of the present invention.

Referring to FIG. 2, the vertical prefabricated composite drain 10 is provided for installation in a generally vertical manner in water saturated soil to be treated for expelling pore water from the soil. With regard to the drawings, the direction vertical with regard to the embodiments illustrated is indicated by the arrow 11 in FIG. 2. In other words, in viewing FIG. 2, the closest portion to the viewer is the bottom end of the composite drain.

The composite drain 10 illustrated in FIG. 2 is of the type generally referred to as a wick drain which has relatively small dimensions. For example, the entire width of the drain 10 in FIG. 2 might typically be 100 mm and the thickness of the corrugated plastic flexible sheet or strip core 12 might typically be 3 mm.

Figure 1:
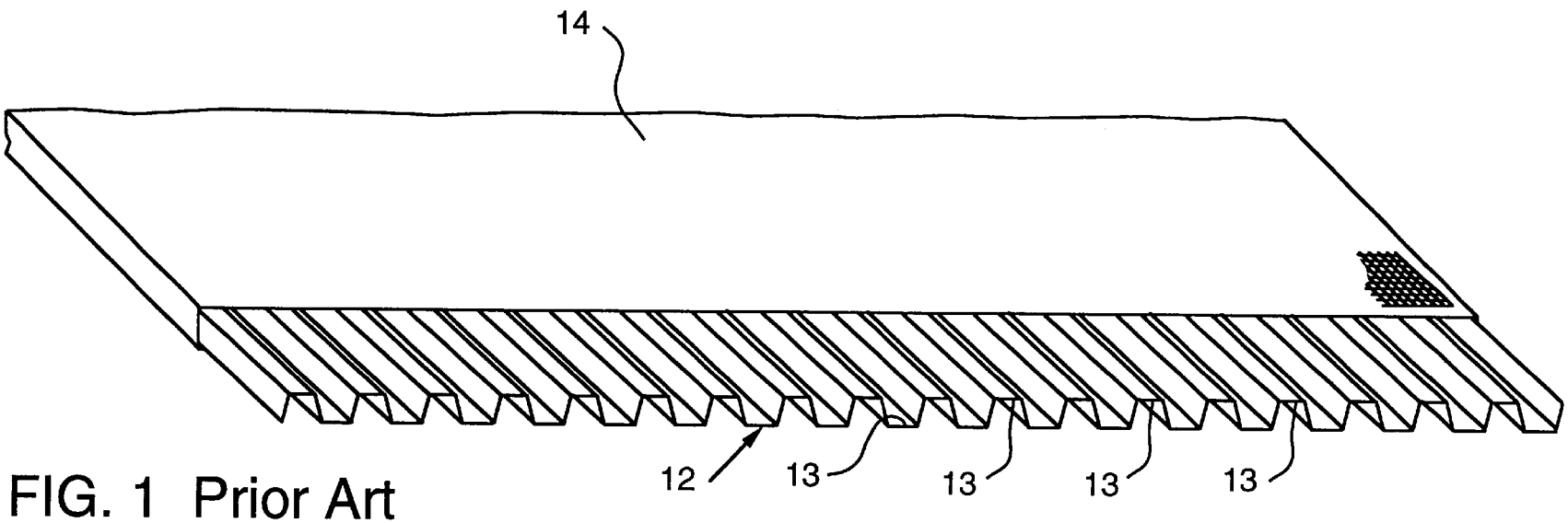
FIG. 1 Prior Art
FIG. 1 is a schematic perspective view of a vertical prefabricated composite drain of the prior art having a corrugated core sheet.

This plastic flexible corrugated sheet core 12 is the same as in the prior art structure illustrated in FIG. 1 and is generally extruded in manufacture.

This elongated drain core 12 is provided with at least one channel therealong for conveying fluids and in this particular embodiment the core 12 is provided with many or multiple drain core channels 13 normally of less than 5 mm in cross section and which are provided by the corrugations of the core 12.

In conventional fashion, as also appears in the prior art structure of FIG. 1, core 12 is surrounded with filter fabric or geofabric 14.

The vertical prefabricated composite drain of the present invention is distinguished over the prior art by the inclusion of elongated tube 15 which is in juxtaposition and coextension with the drain core 12. In addition a fluid pump 16 connected to the top end of tube 15 for forcing fluid through tube 15. In actuality the geofabric or filter fabric 14 extends all the way to the bottom of core 12 and covers end 17 of elongated tube 15. It is cut away to expose the internal parts.

In this embodiment, fluid pump 16 is an air pump which forces air under pressure down into elongated tube 15 where it exits at the bottom 17 and thereby forces water retained within channels 13 of wick drain core 12 upwardly to the surface.

Also in this embodiment, the air pumped by pump 16 into elongated tube 15 is first heated by heater 18 which, as previously explained, further enhances evaporation at the drain surface after the free water within the drain is exhausted.

Figure 3:
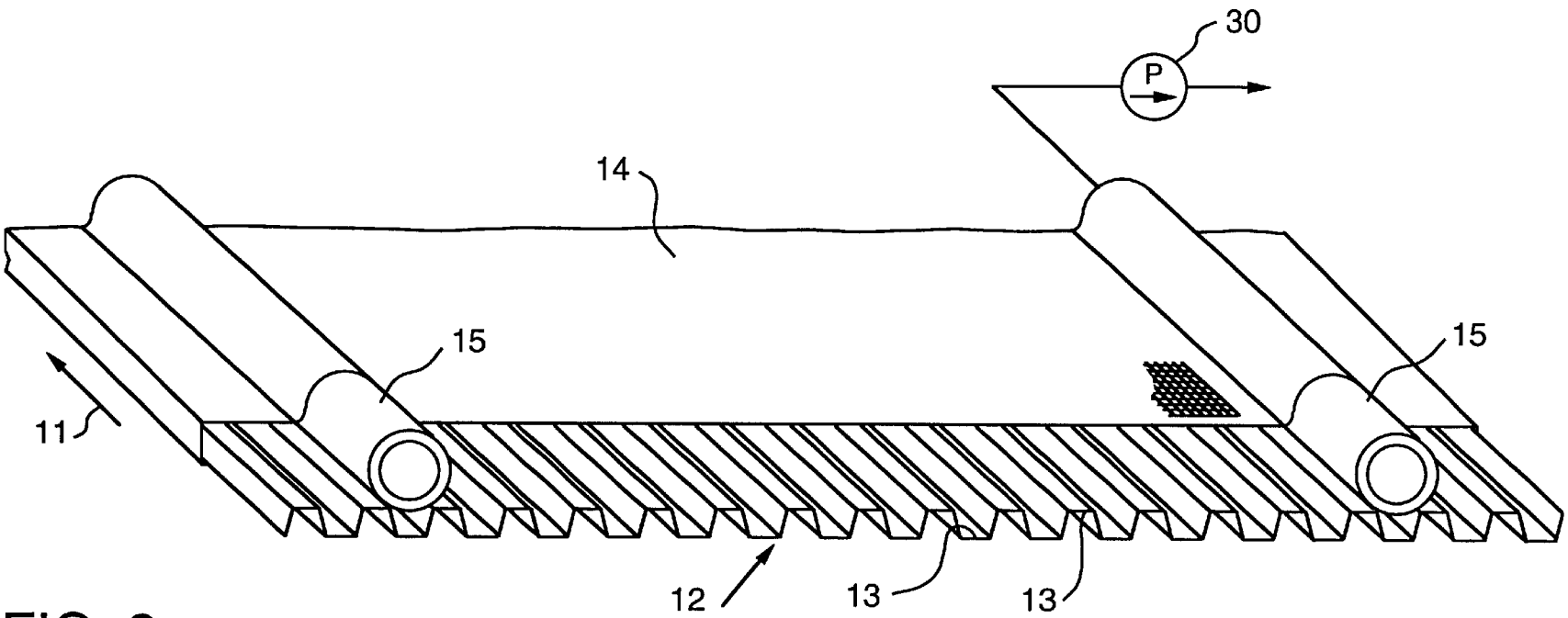
FIG. 3 is a schematic perspective view of another embodiment of the vertical prefabricated composite drain of the present invention.

Referring next to the embodiment of FIG. 3, the composite drain 10 of the present invention is provided with two elongated tubes 15. In all other respects, the embodiment is identical to that illustrated in FIG. 2 and air pumps, or water pumps, may be connected to the upper ends of one or more of the tubes 15 as desired. In fact, a conventional water pump 30 is connected to the upper end of one of the tubes 15 to assist in evacuation of water from the drain channels 13. Pump 30 also evacuates water expelled from the drain whereby the expelled water cannot again penetrate the soil being treated.

Figure 4:
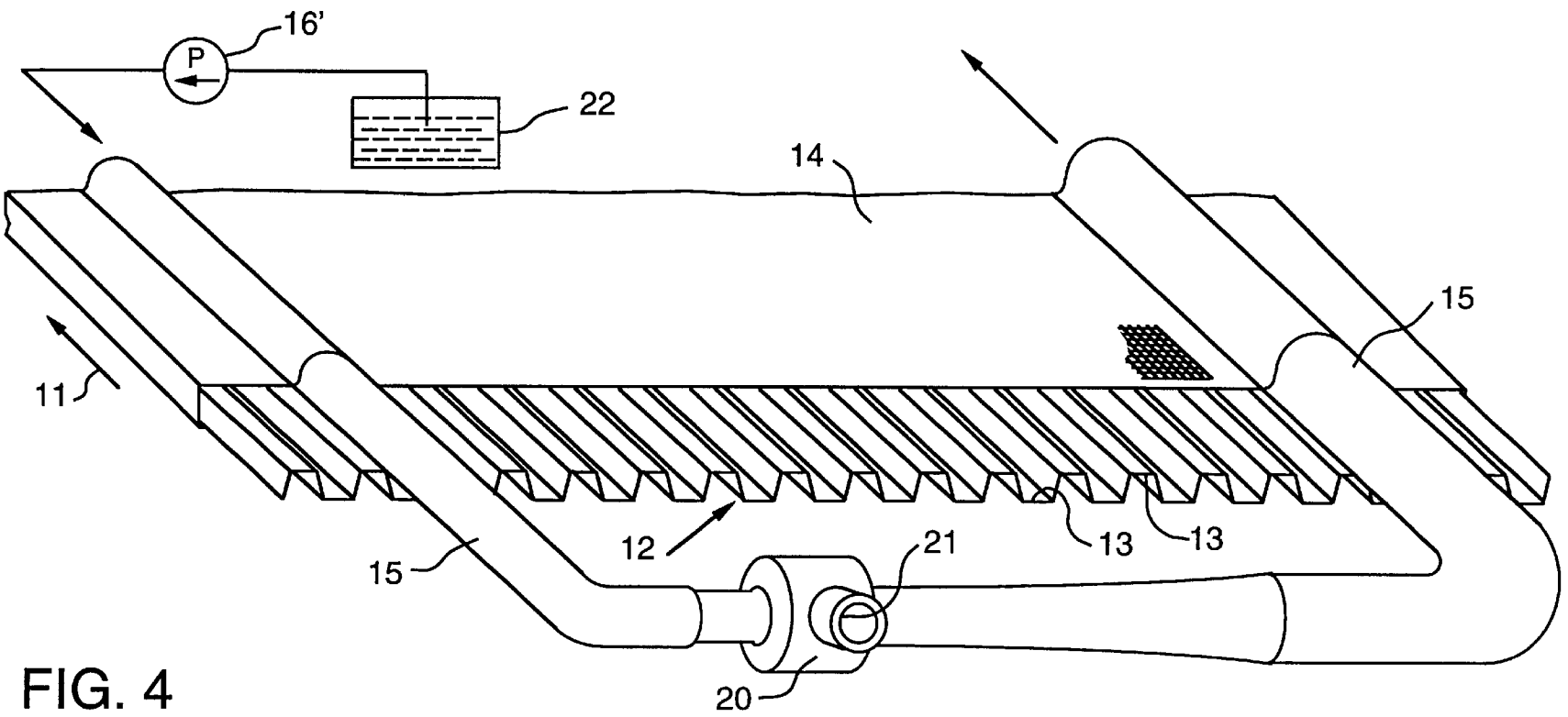
FIG. 4 is a schematic perspective view of a third embodiment of the vertical prefabricated composite drain of the present invention.

The embodiment of FIG. 4 is in all respects identical to the embodiment illustrated in FIG. 3 with the exception that an eductor pump 20 having a suction inlet 21 is connected between the bottom ends of elongated tubes 15 and a water pump 16' is connected to the top end of left hand tube 15 for pumping water downwardly through left hand tube 15, through eductor pump 20 and upwardly through larger right hand elongated tube 15 for evacuating pore water from the bottom of composite drain 10 and from the channels 13 to the soil surface for further evacuation. Water is supplied to water pump 16' from a reservoir 22.

The eductor pump is a known pump generally referred to as a jet pump or a venturi pump, smaller scale than normal, and constructed of plastic. The eductor pump is also covered with the filter fabric 14.

In the embodiments of FIGS. 2 through 4, the elongated drain core 12 is comprised of a flexible plastic corrugated sheet, and in addition, the elongated tubes 15 are also comprised of flexible plastic material for flexing with the core. Accordingly the entire composite drain assembly 10 illustrated may be spooled for storage prior to use.

Figure 5:
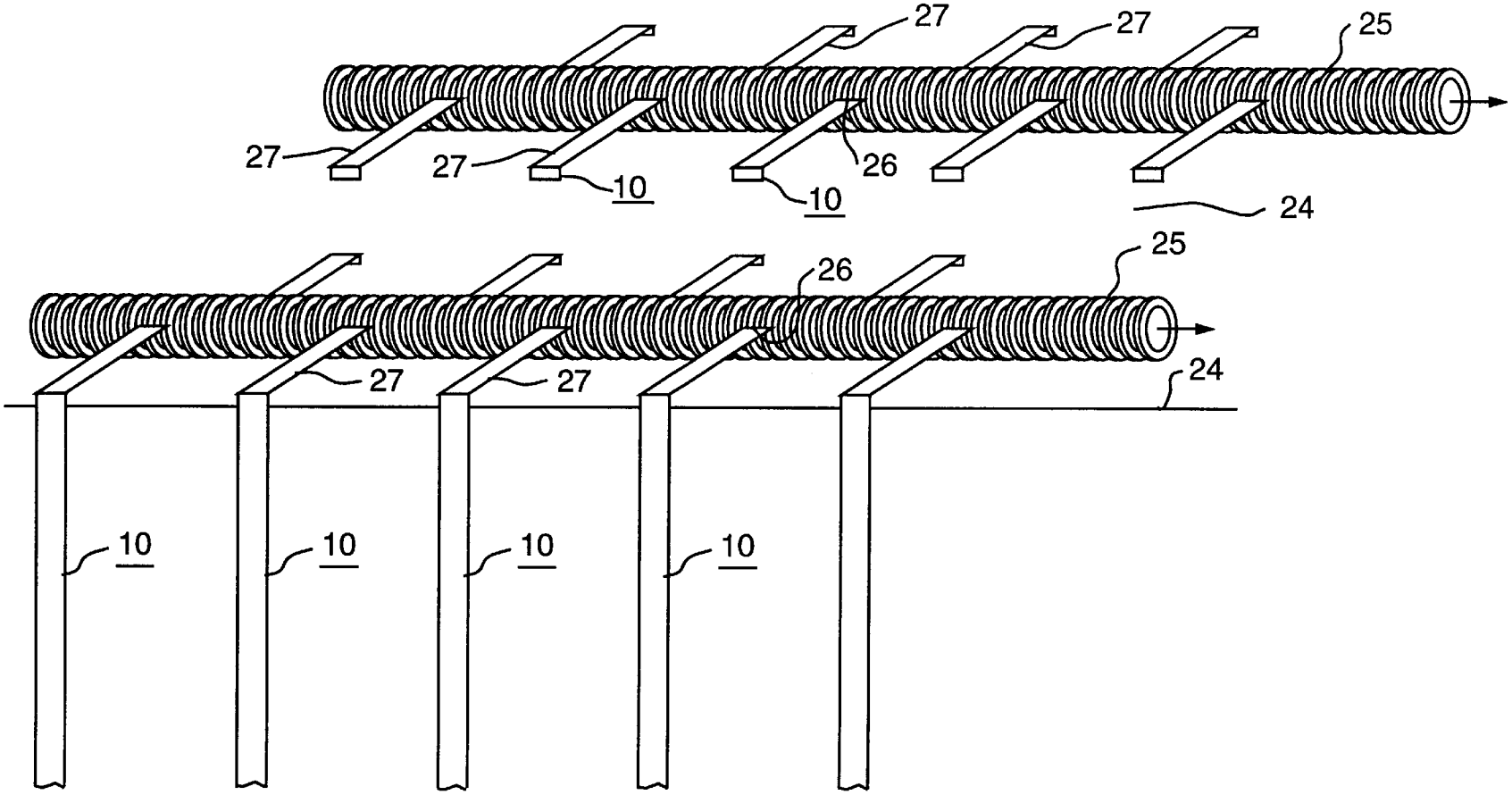
FIG. 5 is a schematic drawing illustrating a horizontal drainage system connected to the upper ends of the vertical prefabricated composite drains of the present invention for evacuating water expelled from the drains.

Referring next to FIG. 5, another illustration of the evacuation means which may be utilized for evacuating water expelled from the drains 10 is shown whereby the expelled water cannot again penetrate the underlying soil 24 being treated.

In this embodiment the horizontal drain system includes horizontal drainage pipes 25 which are constructed of corrugated plastic and are not perforated. Vertical drains 10 of the present invention are either perforated corrugated pipes or corrugated sheets wrapped in geofabric and they are bent to the horizontal and inserted into corresponding openings or slots 26 cut into the corrugated pipes 25. While some of the water will be lost through the geofabric of the exposed portions 27, most of it will be conducted to the horizontal drain pipes 25 and carried away.

I claim:

1. A method of improving the effectiveness of a vertical prefabricated composite drain installed in a generally vertical manner in soil to be treated and extending to the soil surface for expelling pore water from the soil to the surface for evacuation, the method comprising:

(a) installing an elongated tube in juxtaposition and coextension with a vertical prefabricated composite drain in soil with upper ends thereof exposed to an upper surface of the soil; and (b) forcing gas under pressure through said tube for expulsion at the bottom of the drain for thereby assisting in expulsion of water from the drain and the soil and for carrying away soil particles suspended in the water from the drain.

2. The method of claim 1 including heating the gas forced down said tube.

3. The method of claim 1 including evacuating water expelled from the drain whereby expelled water cannot penetrate the soil being treated.

4. The method of claim 1 including installing a second elongated tube in juxtaposition and coextension with said drain and pumping water from the second tube whereby expelled water cannot penetrate the soil being treated.

5. A method of improving the effectiveness of a vertical prefabricated composite drain installed in a generally vertical manner in water saturated soil to be treated and extending to the soil surface for expelling pore water from the soil to the surface for evacuation, the method comprising:

(a) installing two elongated tubes in juxtaposition and coextension with a vertical prefabricated composite drain in soil with upper ends thereof exposed to an upper surface of soil;

(b) connecting an eductor pump between adjacent bottom ends of the tubes; and (c) pumping water through the tubes and eductor pump for evacuating pore water from the drain to a soil surface for further evacuation.

6. A method of improving the effectiveness of a prefabricated composite drain installed in a generally vertical manner in water saturated soil to be treated and extending to the soil surface for expelling pore water from the soil to the surface for evacuation, the method comprising:

(a) installing an elongated tube in juxtaposition and coextension with a vertical prefabricated composite drain in water saturated soil with upper ends thereof exposed to an upper surface of the soil;

(b) forcing fluid under pressure through said tube for thereby withdrawing pore water from the drain and the soil thereby resulting in a decreased amount of pour water in the soil; and (c) wherein forcing fluid includes connecting a pump to the tube and conducting a pumping test on the drain for measuring the permeability of soil surrounding said drain.

7. The method of claim 6 wherein the pumping is conducted for the purpose of forming a graded filter in the soil surrounding the drain.

8. A vertical prefabricated composite drain for installation in a generally vertical manner in water saturated soil to be treated for expelling pore water from the soil comprising:

(a) an elongated flexible drain core with at least one channel therealong for conveying fluids;

(b) an elongated tube in juxtaposition and coextension with the drain core and at least one channel;

(c) a filter fabric surrounding the drain core; and (d) an air pump connected to the top end of the tube for forcing air through the tube.

9. The vertical prefabricated composite drain of claim 8 including a heater connected to said air pump for heating the air pumped by said air pump.

10. The vertical prefabricated composite drain of claim 8 including evacuation means positioned adjacent an upper end of said drain for evacuating water expelled from the drain whereby expelled water cannot penetrate soil being treated.

11. The vertical prefabricated composite drain of claim 10 wherein said evacuation means includes horizontal drain pipes connected to an upper end of the composite drain.

12. The vertical prefabricated composite drain of claim 8 wherein said elongated drain core is comprised of a flexible plastic sheet with longitudinal channels providing a plurality of said at least one channel, and said tube is also comprised of flexible plastic material for flexing with said core.

13. The vertical prefabricated composite drain of claim 12 wherein said channels are less than 5 mm in cross section.

14. The vertical prefabricated drain of claim 8 wherein the drain consists of perforated corrugated plastic pipe.

15. A vertical prefabricated composite drain for installation in a generally vertical manner in water saturated soil to be treated for expelling pore water from the soil comprising:

(a) an elongated prefabricated flexible core with at least one channel therealong for conveying fluids;

(b) two elongated tubes in juxtaposition and coextension with the drain core;

(c) a filter fabric surrounding the drain core with at least one channel;

(d) an eductor pump connected between bottom ends of said tubes; and (e) a water pump connected to the top of one of the said tubes for pumping water through the tubes and said eductor.

* * * * *